United States Patent [19]

Bakermans

[11] Patent Number: 4,887,452

[45] Date of Patent: Dec. 19, 1989

[54] SPROCKET-TYPE STRIP FEED

[75] Inventor: Johannes C. W. Bakermans, Harrisburg, Pa.

[73] Assignee: AMP Incorporated, Harrisburg, Pa.

[21] Appl. No.: 284,516

[22] Filed: Dec. 15, 1988

[51] Int. Cl.[4] ..... B21D 28/04

[52] U.S. Cl. ..... 72/420; 72/335; 72/405; 83/278; 226/143

[58] Field of Search ..... 72/420, 421, 405, 384, 72/394, 335; 226/82, 83, 86, 87, 143; 83/278, 423

[56] References Cited

U.S. PATENT DOCUMENTS

| | | | |
|---|---|---|---|
| 1,031,468 | 7/1912 | Power | 83/278 |
| 1,370,381 | 3/1921 | Tarbox | 72/405 |
| 2,309,942 | 2/1943 | Ekstedt et al. | 72/335 |
| 3,121,654 | 2/1964 | Heidergott et al. | 83/278 |
| 3,292,236 | 12/1966 | Busler et al. | 29/33.5 |
| 4,309,370 | 1/1972 | Sizemore et al. | 264/40.5 |
| 4,345,889 | 8/1982 | Sizemore et al. | 425/122 |
| 4,497,196 | 1/1985 | Bakermans et al. | 72/405 |
| 4,822,192 | 4/1989 | Morita | 226/83 |

*Primary Examiner*—Lowell A. Larson

*Attorney, Agent, or Firm*—Frederick W. Raring; James M. Trygg

[57] ABSTRACT

Strip feeding mechanism intended for use in a stamping and forming machine comprises an intermittently rotated sprocket wheel which is located adjacent to the operating zone of the machine in which the stamping and tooling is located. The strip material is held against the periphery of the sprocket wheel by a retaining shoe so that the sprocket teeth will enter pilot holes in the strip and advance the strip during feeding intervals. During non-feeding intervals, the pilot pins which are part of the stamping and forming tooling, will adjust the position of the strip relative to the tooling performing the operation thereon. The construction of the biasing shoe and the sprocket wheel is such that the strip is not firmly held by the feeding mechanism and can be moved by a very slight amount by the pilot pins in order to position the strip precisely in the operating zone.

7 Claims, 5 Drawing Sheets

SPROCKET-TYPE STRIP FEED

FIELD OF THE INVENTION

This invention relates to strip feeding mechanisms for intermittently feeding strip material along a feed path. The invention is particularly intended for use in stamping and forming machines in which individual parts or articles are stamped and formed in a plurality of die stations.

BACKGROUND OF THE INVENTION

U.S. Pat. No. 4,497,196 (which is hereby incorporated by reference in its entirety) discloses a stamping and forming machine comprising a plurality of individual modules, each of which contains a set of stamping and/or forming tooling. Strip material is fed intermittently through the machine and during dwell periods the tooling in each of the modules performs an operation on the strip such as blanking, coining, and forming. Machines of the type shown in the above-identified U.S. patent require at least one feeding mechanism for feeding the strip material and where the machine contains a plurality of modules, it is preferable to provide an individual feeding unit for each of the modules.

In any stamping and forming process in which precisely dimensioned parts are being produced, it is essential that the strip be located in each of the die stations with a high degree of precision for the reason that if the feeding operation is not precisely controlled, the articles or parts produced will not be held to close dimensional tolerances. For example, a strip of electrical terminals is commonly produced by feeding strip material through a plurality of die stations so that one operation can be carried out on the strip at each of the stations. The article being produced may be blanked at the first station, partially formed at the second station, coined at the third station, and subsequently subjected to additional forming and other operations. If the resulting terminals are to be manufactured to close dimensional tolerances, it is essential that the partially formed parts be precisely located in each of the die stations with respect to the tooling (punches, forming dies, shearing dies, etc.) in order to maintain precisely controlled dimensions in the finished terminals. Most feeding mechanisms used on stamping and forming machines are incapable of feeding the strip material during each feeding cycle with the precision required for the production of precisely dimensioned parts and it is therefore common practice to use pilot pins in the die assembly which serve precisely to position the strip with respect to the forming tooling after feeding has taken place. The pilot pins may be provided on the die shoe and extend therefrom beyond the ends of the forming tooling (the punches or other tooling). The pilot pins enter pilot holes which are precisely located in the strip and move it by a very slight amount so that it is precisely positioned with respect to the tooling prior to engagement of the tooling with the strip material.

The use of pilot pins in a stamping and forming die assembly requires that the strip be capable of moving a very slight amount when the pilot pins enter the pilot holes. In other words, the strip cannot be held by the feed mechanism or otherwise while the pilot pins are entering the pilot holes for the reason that it would then be impossible for the pilot pins to serve their function of adjusting the position of the strip with reference to the forming tools.

U.S. patent application Ser. No. 057,556, filed June 3, 1987 describes a strip feed mechanism for a multi-station stamping and forming machine in which the strip is fed by a sprocket wheel that is intermittently rotated by means of a suitable geneva mechanism or otherwise to feed the strip. The strip is held against the periphery of the sprocket wheel so that the sprocket teeth will enter the pilot holes in the strip by means of a biasing or holding shoe. The shoe, however, is moved away from the strip during non-feeding intervals so that the strip is released and when the pilot pins enter the pilot holes at an adjacent forming station, the strip is free to move for final and precise adjustment as discussed above. The feeding mechanism described in application Ser. No. 057,556 is being used successfully; however, the mechanism which is employed to hold the shoe against the strip and against the sprocket wheel during feeding intervals and move the shoe away from the sprocket during non-feeding intervals is relatively complex and it has been found that it is not required in all stamping and forming operations. The present invention is directed to the achievement of an improved mechanism for holding the strip material against the sprocket wheel during feeding intervals and releasing the strip material for limited movement during non-feeding intervals so that the pilot pins can precisely position the strip with respect to the tooling.

THE INVENTION

The invention comprises a machine, such as a stamping and forming machine, having an operating zone and having a feed sprocket adjacent to the operating zone for feeding strip material intermittently therethrough. Sprocket actuating means are provided for intermittently rotating the feed sprocket and the strip material has pilot holes at uniformly spaced intervals which receive the sprocket teeth. The operating zone of the machine has pilot pins therein which are moved into the pilot holes in the portion of the strip which is in the operating zone during non-feeding intervals thereby precisely to position the portion of the strip which is in the operating zone with respect to the tooling. The strip and the sprocket wheel have a tangency location at which the strip is tangent to the sprocket. The machine is characterized in that the sprocket teeth are generally conical and have a base diameter which is substantially equal to, and less than, the diameter of the pilot holes. The sprocket actuating means is timed to locate one sprocket tooth at the tangency location during non-feeding intervals with the one tooth extending into a pilot hole. During non-feeding intervals, the sprocket teeth which are on each side of the one tooth are not in engagement with the strip. Means are providing for holding the strip against the sprocket at the tangency location. During operation, and upon movement of the pilot pins into the strip material during non-feeding intervals, the strip can be moved along its length by the pilot pins with accompanying movement of the strip laterally of its plane and radially away from the periphery of the feed sprocket.

The strip has a predetermined pitch (distance between adjacent pilot holes) and the strip is fed by a predetermined feed length during each operating cycle, the feed length being a whole number multiple of the pitch. The sprocket wheel has a predetermined diameter and each of the sprocket teeth has a predetermined height with respect to the periphery of the sprocket. The diameter and the height are such that during each feeding interval, the strip is initially fed by the one sprocket tooth which was at the tangency location during the immediately preceding non-feeding interval. Prior to disengagement of the one tooth from the strip, the next adjacent tooth comes into engagement with the strip. Advantageously, the means for holding the strip against the periphery of the sprocket wheel comprises a shoe having a strip supporting surface and a channel extending therethrough which is dimensioned to receive the sprocket teeth.

THE DRAWING FIGURES

THE DISCLOSED EMBODIMENT

Figure 1:
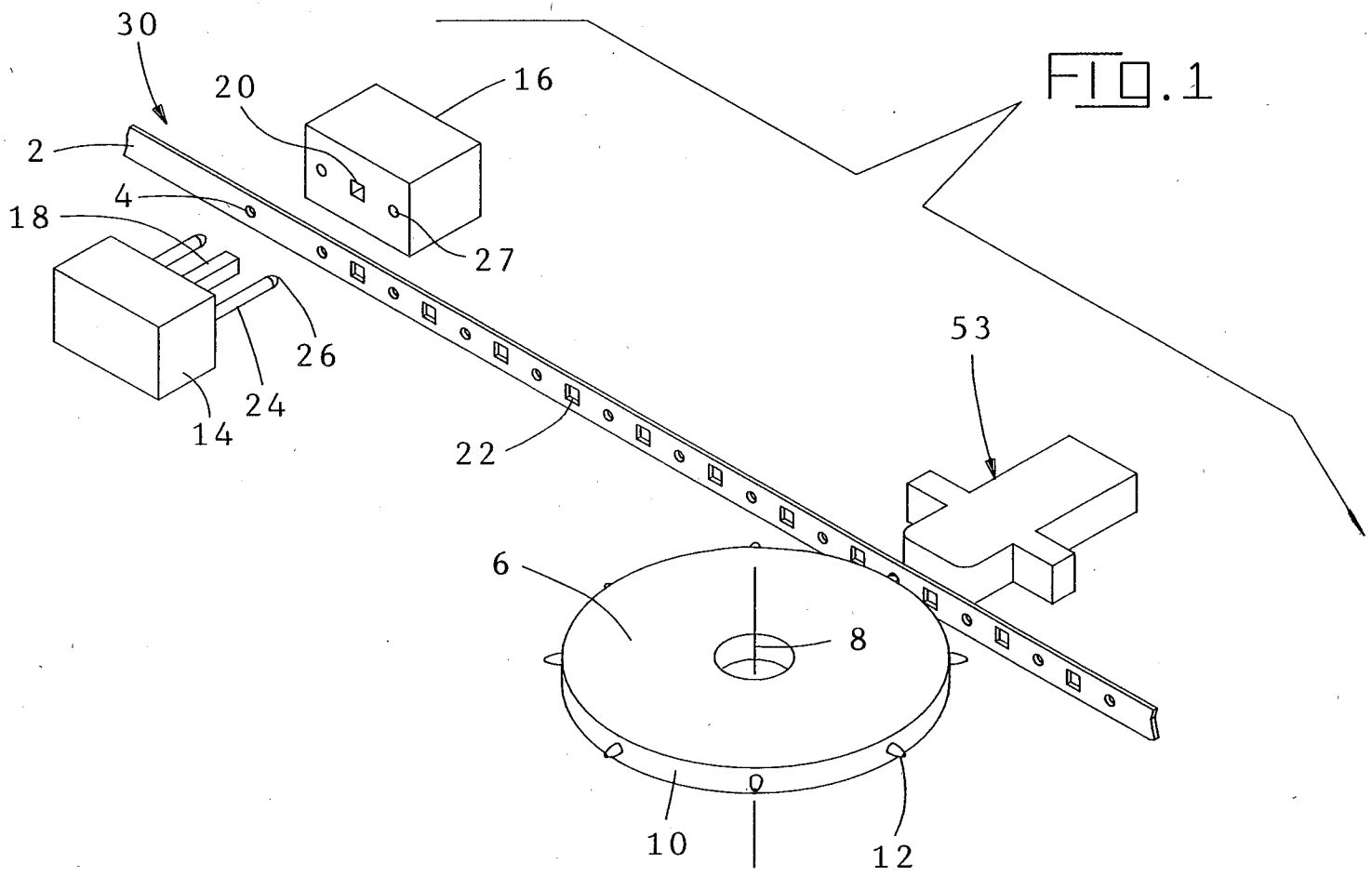
FIG. 1 is a perspective diagrammatic view which illustrates the manner in which strip material is fed through the operating zone of a stamping and forming machine by a sprocket wheel.

Referring to FIG. 1, the strip material 2 has spaced-apart pilot holes 4 therein and is fed intermittently through an operating zone 30 by a sprocket 6 which is rotated about a central axis 8 and which has sprocket teeth 12 on its periphery 10. The operating zone 30 would be contained in an individual module of the type shown in the above-identified patent U.S. Pat. No. 4,497,196 and the sprocket wheel 6 would be located downstream, relative to the direction of strip feed, from the module. The operating zone has opposed rams 14, 16 therein which are movable from open positions, shown in FIG. 1, to closed positions in which they are against the strip material. The ram 14 has tooling thereon represented by a simple rectangular punch 18 that extends from the face of the ram. The ram 16, which is a die ram, has a square opening 20 dimensioned to receive the punch so that when the two rams move to their closed positions, a square opening 22 is punched in the strip. In order precisely to position the portion of the strip which is in the operating zone with respect to the tooling 18, pilot pins 24 are provided on the ram 14. These pilot pins extend from the face of the ram and have outer free ends 26 which are located beyond the end of the punch 18 so that the leading ends of the pilot pins will enter the pilot holes 4 prior to engagement of the punch 18 with the strip material. The pilot pins will precisely locate the portion of the strip material in the operating zone by moving it by a very slight distance along its length in either direction. The amount of such movement is extremely slight, of the order of about 0.001 inches or even less. This slight movement of the strip requires that the strip be free to move in the vicinity of the sprocket 6 and that it not be held firmly on the sprocket teeth or by any other feed mechanism. During feeding intervals, the strip material is held against the periphery of the sprocket wheel by a shoe which is diagrammatically indicated at 53 in FIG. 1. The shoe, the sprocket wheel, and particularly the sprocket teeth 12 are such that the strip can be moved by a slight amount by the pilot pins 24 notwithstanding the fact that the strip is between the shoe and the periphery of the sprocket wheel and is held against the sprocket wheel as will be described below.

The operating embodiment of the invention, FIGS. 2–5, is shown as being located adjacent to a housing wall 28 of a module of the type described in the above-identified U.S. Pat. No. 4,497,196. The operating zone is indicated at 30 on the left of the feed mechanism and the strip material is fed from the operating zone and guided by a guide block 32 to the vicinity of the sprocket wheel. This guide block is secured to the wall 28 of the housing and has a channel 34 therein through which the strip is fed to the strip feed assembly 36. The strip is guided from the sprocket wheel by a downstream guide 38 having a channel 39 therein. The guide 39 is secured by fasteners to a mounting block 42 which has a leftwardly extending (as viewed in FIG. 2) arm 44 that is secured by suitable fasteners to a horizontally extending support plate 40 which supports, in addition to the block 42, portions of the strip feed mechanism. A strip retaining plate 46 is fastened to the face of the block 38 and has an end 48 which is adjacent to the periphery of the feed sprocket 6. This retaining plate is provided in order to ensure that the strip material will enter the channel 39 and will not follow an arcuate path as it leaves the periphery of the feed sprocket.

Figure 5:
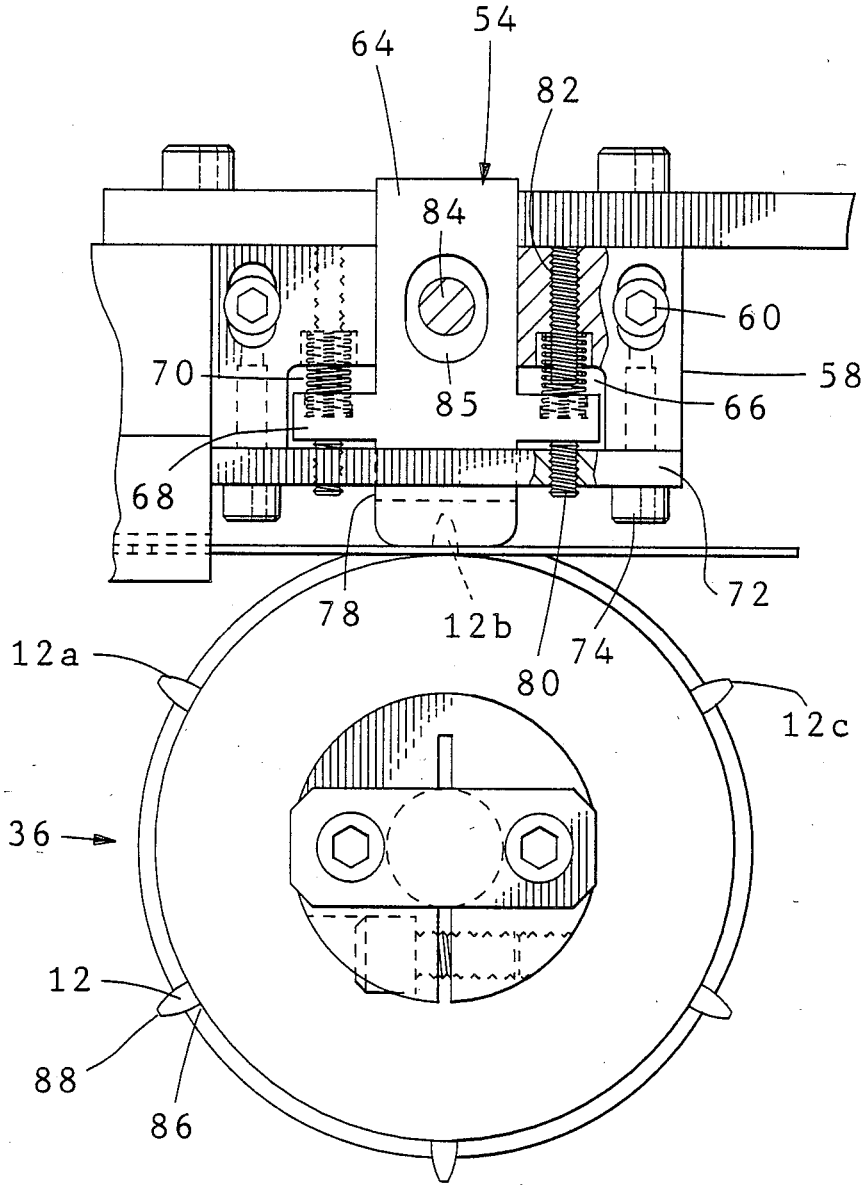
FIG. 5 is a top plan view, on an enlarged scale, showing the feed sprocket and the shoe which holds the strip against the feed sprocket.

The axis of rotation for the feed sprocket 6 is the output shaft 8 of a suitable mechanism 50 which is effective to rotate the shaft 8 intermittently by a predetermined amount. The actuator 50 may be of any suitable type and good results have been achieved with a geneva mechanism which is available from the Cam Co Division of Emerson Electric Company, Wheeling, Ill. The shaft 8 has a shoulder 52 against which the sprocket is positioned and the sprocket has an integral collet 54 having slots as shown so that it can be clamped to the end of the shaft by a clamping collar 56 having a slot and set screw or clamping screw as shown in FIG. 5. When the feeding mechanism is being adjusted for a particular feeding situation, it is necessary that the feed sprocket be clamped to the shaft 8 in a specific angular orientation and to this end, a clamping block 47 is provided which is secured by fasteners 51 to the upper surface of the collar 56. This clamping block has a centrally located key 49 which is received in a slot in the collet 54 and in a slot in the shaft 8 when the particular angular position of adjustment is determined.

Figure 2:
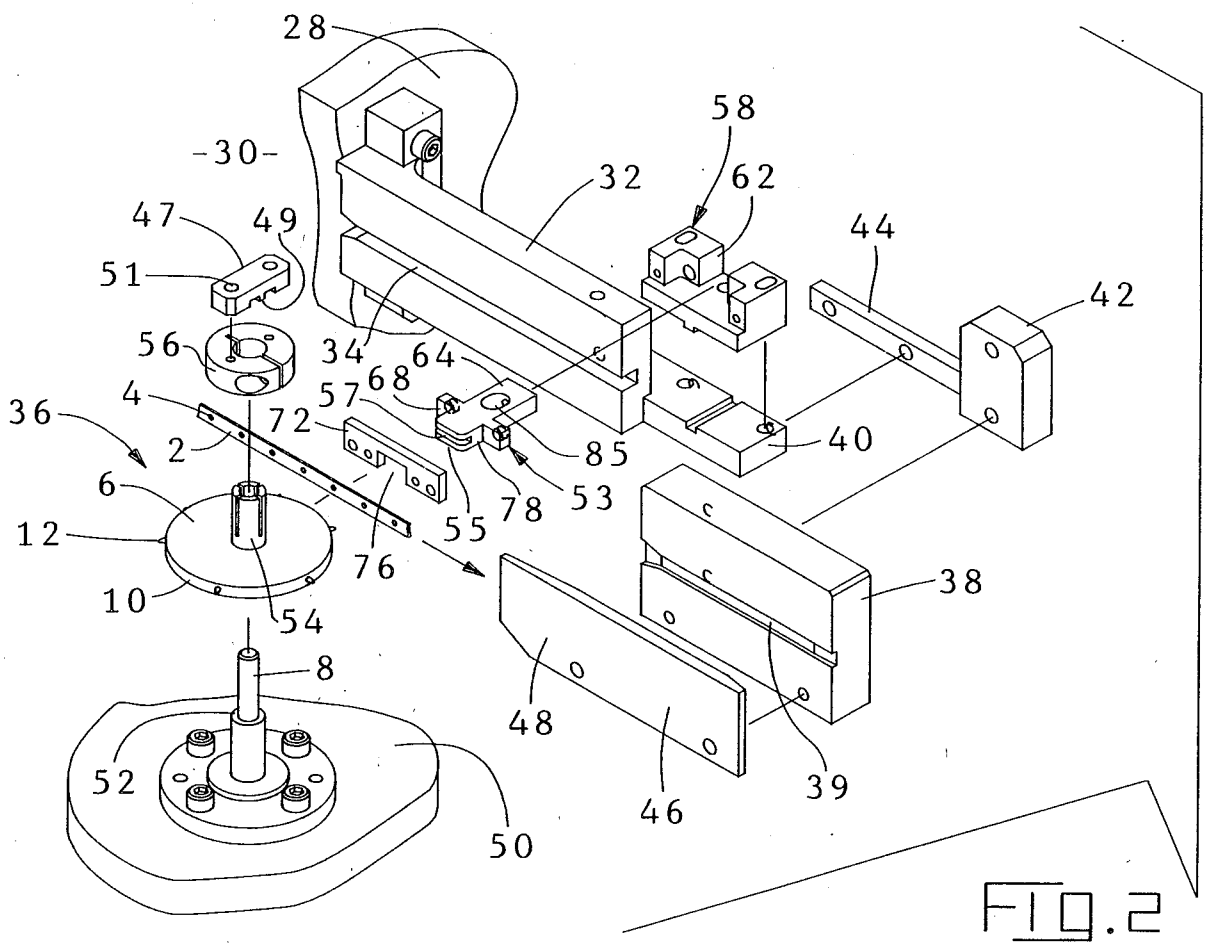
FIG. 2 is a perspective view, with the parts exploded from each other, of a feed mechanism in accordance with the invention.
Figure 3:
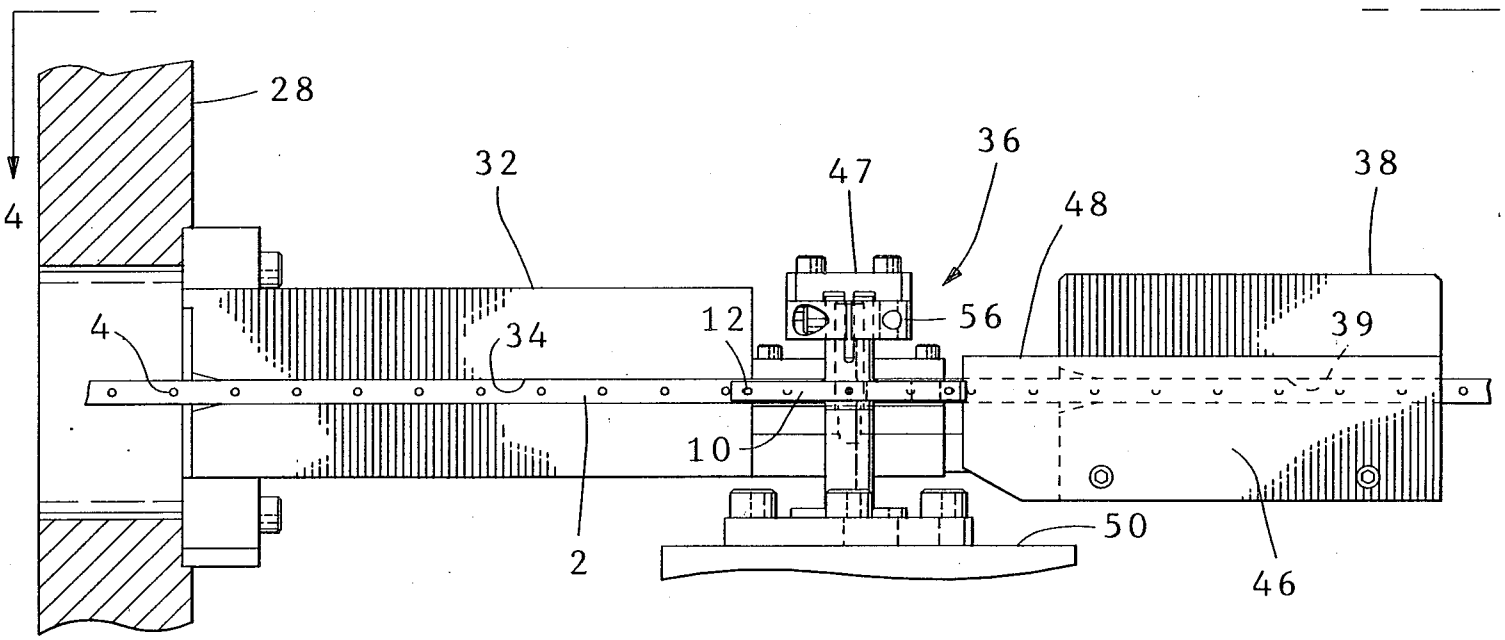
FIG. 3 is a side view, looking from the left in FIG. 2, of the assembled feed mechanism showing its relationship to the strip which is fed.
Figure 4:
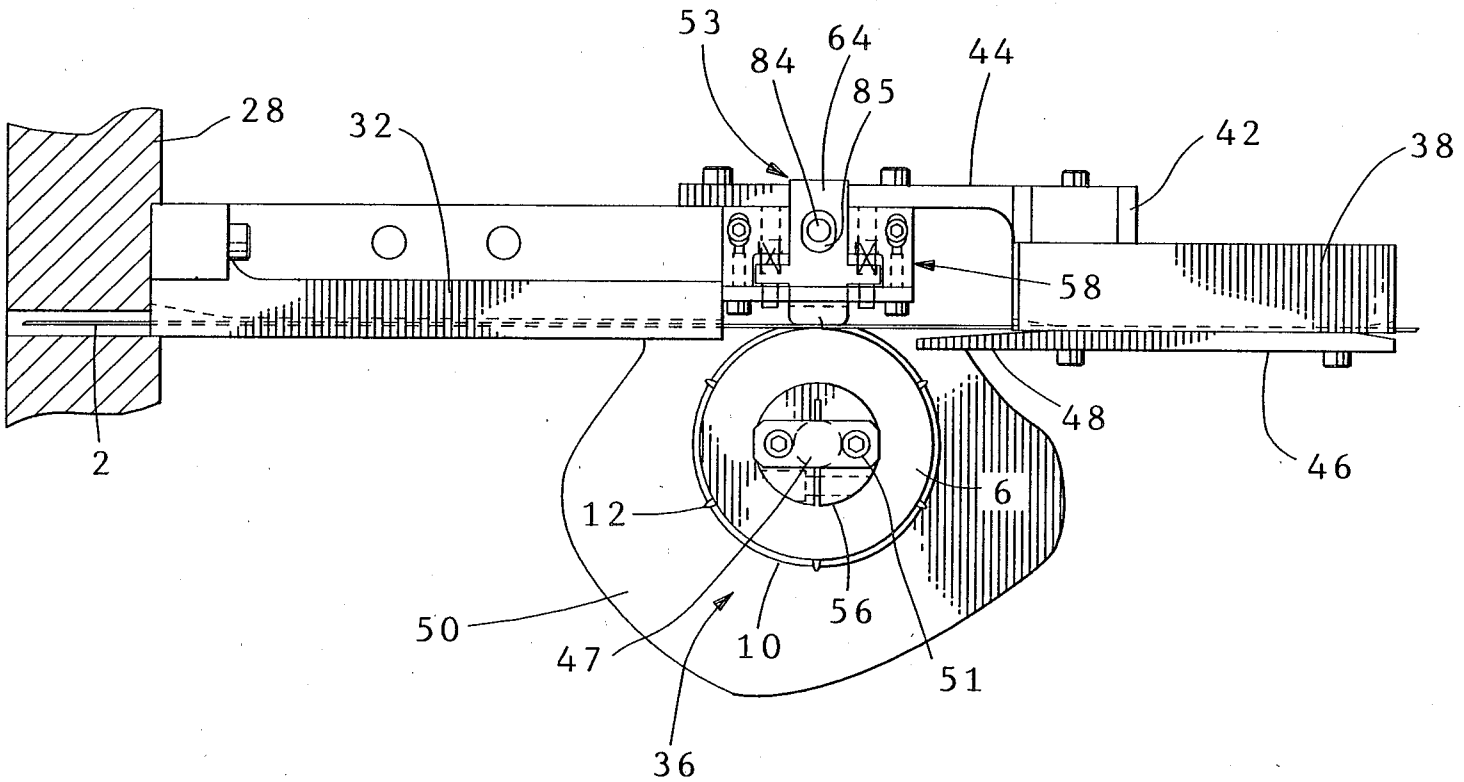
FIG. 4 is a view looking in the direction of the arrows 4—4 of FIG. 3.

The shoe 53 has a surface 55 which is substantially against a side surface of the strip and which holds the strip against the periphery 10 of the feed sprocket. The surface 55 has a channel 57 extending therethrough which is dimensioned to receive the sprocket teeth. The shoe 53 is supported in a support block 58 which is adjustably secured by suitable fasteners to the previously identified support plate 40 and which has a recess or gap 62 therein that receives the trailing end portion 64 of the shoe. The leftwardly facing portion of the block 58, as viewed in FIG. 2, is recessed on each side of the opening 62 for the reception of arms 68 which extend from the forward portion 78 of the shoe.

A stop plate 72 is secured by fasteners 74 against the face of the block 58 and has a central notch 76 through which the forward portion 78 of the shoe 53 projects. The surface of this stop plate can function as a stop for the arms 68 of the shoe or alternatively, set screws can be threaded into the plate 72 as shown at 80 and can be adjusted precisely to determine the limit of movement of the shoe against the strip material. The shoe 53 is held slidably on the block by means of a retaining screw 84 which extends through an elongated slot 85 in the trailing portion 64 of the shoe.

The limit of movement of the shoe 53 away from the periphery of the sprocket is limited by stop screws 82 which are threaded through the block and have ends which are in the recess 66. The stop screws 80 and 82 should be adjusted such that the tooth **12*b* shown in FIG. 5 will always have its free end in the channel 57 in the shoe so that the strip will not be released from the tooth. The amount of movement permitted the shoe 53 by the screws 80, 82** should be such that the strip is permitted to move radially away from the periphery of the sprocket when the position of the strip is precisely adjusted by the pilot pins.

Under some conditions, it may be desirable to provide springs 70 between the block 58 and the shoe 53 in order to bias the shoe against the strip while permitting the slight radial movement of the strip described above. In the embodiment shown, these springs are in surrounding relationship to the ends of the screws 82 and are received in recesses in the arms 68 and the block 58. The springs 70 may be helpful when the stamping and forming machine is being operated at relatively low speed but at high operating speeds (1200 RPM or higher) the springs are not required.

The individual sprocket teeth 12 have a base 86 at the periphery of the sprocket wheel and have an outer end 88 which has a predetermined height above the surface of the periphery. The sprocket teeth are generally conical and have a diameter at the base thereof which is substantially equal to, and less than, the minimum diameter of one of the pilot holes 4. The expression "substantially equal to and less than" means that the tolerances for the teeth should be such that under no circumstances will the diameter of a tooth be greater than the minimum diameter of one of the pilot holes and will in fact always be less than the minimum pilot hole diameter.

The successful practice of the invention requires that the diameter of the sprocket wheel, the distance between adjacent teeth on the periphery of the wheel, and the length of the feed stroke be interrelated in a manner which is described below.

As shown clearly in FIG. 5, during a non-feeding interval, the strip extends past the sprocket at a tangency location and one feed tooth identified as **12*b*, is at the tangency location and extends through a pilot hole. The adjacent sprocket teeth 12*a*, and 12*c*, are not in engagement with the strip so that when pilot pins in the operating zone of the machine enter the strip and move it slightly rightwardly or leftwardly as viewed in FIG. 5, the strip can move over the surface of the sprocket tooth 12*b* and the shoe 53 will yield very slightly to permit such movement. In other words, in moving along its length as a result of the entry of the pilot pins into the strip, the strip is also required to move radially by a very slight amount away from the center of the sprocket wheel. It is for this reason that there cannot be additional teeth, other than the tooth 12*b***, in engagement with the strip for such additional teeth would not permit the movement of the strip relative to the sprocket wheel.

During a feeding interval, the sprocket wheel will turn in the direction of the arrow shown in FIG. 5 and the tooth **12*b* will begin to feed the strip rightwardly from the position shown. The tooth 12*b* will remain in engagement with the strip for a limited time and prior to disengagement of the tooth 12*b* from the strip, the tooth 12*a*** will come into engagement with the strip by entering an adjacent pilot hole.

It will be apparent from the foregoing discussion that the sprocket wheel must be stopped at one of several predetermined locations at the end of each feeding interval; specifically, the sprocket wheel must be stopped with one of its teeth at the tangency location. It follows that the amount by which the strip is fed during each feeding interval must be a whole number multiple of the pitch of the strip; that is, the distance between adjacent pilot holes which are engaged by the sprocket teeth. The minimum amount by which the strip can be fed during a feeding interval is equal to the distance along the periphery of the sprocket wheel between two adjacent sprocket teeth or, in other words, the distance between two adjacent pilot holes which are engaged by the sprocket teeth.

In a specific stamping and forming machine, it is necessary to provide a different sprocket wheel for each feeding length required. The sprocket wheel must be designed such that it will have only one sprocket tooth in engagement with the strip at the tangency location during non-feeding intervals and it must be designed such that the feed stroke is equal to the distance between two adjacent sprocket teeth or a whole number multiple of that distance. The actual amount of the feed stroke can be changed by adjusting the degrees of rotation of the output shaft 8 of the actuator mechanism 50.

The requirement that a different sprocket wheel be provided for each feeding operation is not disadvantageous, particularly if long production runs are being made and precise feeding of the stock is required. The sprocket wheel is of relatively simple construction and it can readily be mounted on and removed from the output shaft 8 of the actuator mechanism 50 as discussed below.

It will be apparent from the foregoing description that the invention achieves the advantages of a sprocket feed (as compared to a reciprocating feeding mechanism such as a hitch feed) and, at the same time, permits the very limited movement of the strip during non-feeding intervals which is required when the pilot pins enter pilot holes in the strip in the operating zone. Important features of the invention, which permit this limited strip movement, are the fact that only one sprocket tooth is in engagement with the strip at the tangency location during non-feeding intervals and the fact that the shoe permits this limited movement while retaining the strip on the one tooth.

I claim:

1. A machine, such as a stamping and forming machine, having an operating zone and having a feed sprocket adjacent to the operating zone for feeding strip material intermittently through the operating zone, sprocket actuating means for intermittently rotating the feed sprocket, the strip material having pilot holes therein at uniformly spaced intervals, the operating zone having pilot pins therein which are moved into the pilot holes in the portion of the strip which is in the operating zone during non-feeding intervals, the sprocket having sprocket teeth on the periphery thereof which are dimensioned to enter the pilot holes and which are spaced apart by the same amount as the pilot holes, the strip and the sprocket wheel having a tangency location at which the strip in tangent to the sprocket, the machine being characterized in that:

the sprocket teeth are generally conical and have a base diameter which is substantially equal to, and less than, the diameter of the pilot holes, the sprocket actuating means is timed to locate one sprocket tooth at the tangency location during non-feeding intervals with the one tooth extending into a pilot hole, during non-feeding intervals, the sprocket teeth on each side of the one tooth are not in engagement with the strip, and retaining means are provided for retaining the strip against the sprocket wheel at the tangency location whereby, with the one sprocket tooth extending into the pilot hole, the retaining means permitting limited radial movement of the strip on the one tooth radially away from the periphery of the sprocket wheel upon movement of the pilot pins into the strip material during non-feeding intervals, the strip can be moved along its length by the pilot pins with accompanying movement of the strip laterally of its plane and radially away from the periphery of the feed sprocket.

2. A machine as set forth in claim 1 characterized in that the strip has a predetermned pitch and the strip is fed by a predetermined feed length during each operating cycle, the feed length being a whole number multiple of the pitch.

3. A machine as set forth in claim 2 characterized in that the sprocket wheel has a predetermined diameter and each of the sprocket teeth has a predetermined height with respect to the periphery of the sprocket, the diameter and the height being such that during each feeding cycle, the strip is initially fed by the one sprocket tooth which was at the tangency location during the immediately preceding non-feeding interval and, prior to disengagement of the one tooth from the strip, the next adjacent tooth comes into engagement with the strip.

4. A machine as set forth in either of claims 1 or 3 characterized in that the retaining means comprises a shoe having a strip supporting surface which is adjacent to the periphery of the sprocket at the tangency location, the strip being between the periphery of the sprocket and the strip supporting surface.

5. A machine as set forth in claim 4 characterized in that the shoe has a channel extending therethrough which intersects the strip supporting surface, the channel being dimensioned to receive the sprocket teeth.

6. A machine as set forth in claim 5 characterized in that a static strip guide assembly is provided for guiding the strip to, and away from, the tangency location, the strip guide assembly having a mounting bracket thereon in the vicinity of the tangency location, the shoe being slidably mounted on the bracket, and spring means are provided which are effective to bias the mounting shoe against the strip.

7. A machine as set forth in clalm 5 characterized in that a static strip guide assembly is provided for guiding the strip to, and away from, the tangency location, the strip guide assembly having a mounting bracket thereon in the vicinity of the tangency location, the shoe being slidably mounted on the bracket, and stop means are provided for limiting the movement of the shoe towards and away from the sprocket, the stop means being effective to ensure that the one tooth at the tangency location is always in the channel in the shoe.

* * * * *